United States Patent [19]

Johnston

[11] Patent Number: 4,504,994

[45] Date of Patent: Mar. 19, 1985

[54] APPARATUS FOR APPLYING AND WORKING A CLEANSING PREPARATION ON CONTACT LENSES

[76] Inventor: Calvin M. Johnston, 4440 Central Ave., Apt. #6, Charlotte, N.C. 28205

[21] Appl. No.: 568,296

[22] Filed: Jan. 5, 1984

[51] Int. Cl.[3] ..... B08B 11/02

[52] U.S. Cl. ..... 15/104.92; 15/104.94; 15/214; 15/244 R

[58] Field of Search ..... 15/104.92, 104.94, 21 A, 15/210 R, 214, 244 R

[56] References Cited

U.S. PATENT DOCUMENTS 3,378,873 4/1968 Strout ..... 15/104.92

4,187,574 2/1980 Wrue ..... 15/210 R

*Primary Examiner*—Edward L. Roberts

*Attorney, Agent, or Firm*—Richards, Shefte & Pinckney

[57] ABSTRACT

An apparatus for cleaning conventional contact lenses with a suitable cleansing preparation including a body formed of a soft, slightly abrasive material and having a recessed area formed therein for receiving a contact lens. A handle assembly includes a projecting portion of the same or a similar soft, slightly abrasive material which can be inserted in the recess to engage the lens and manipulate it to be rubbed on its inward and outward surfaces by the surface of the body recess and the surface of the handle projecting portion. The cleaning operation is carried out by first applying the cleaning preparation to the concave recessed surface of the body and to the convex projecting portion of the handle assembly, placing the lens in the recessed area 22 and inserting the projecting portion of the handle assembly therein and manipulating the lens against the surfaces to apply the cleaning preparation to the lens.

9 Claims, 1 Drawing Figure

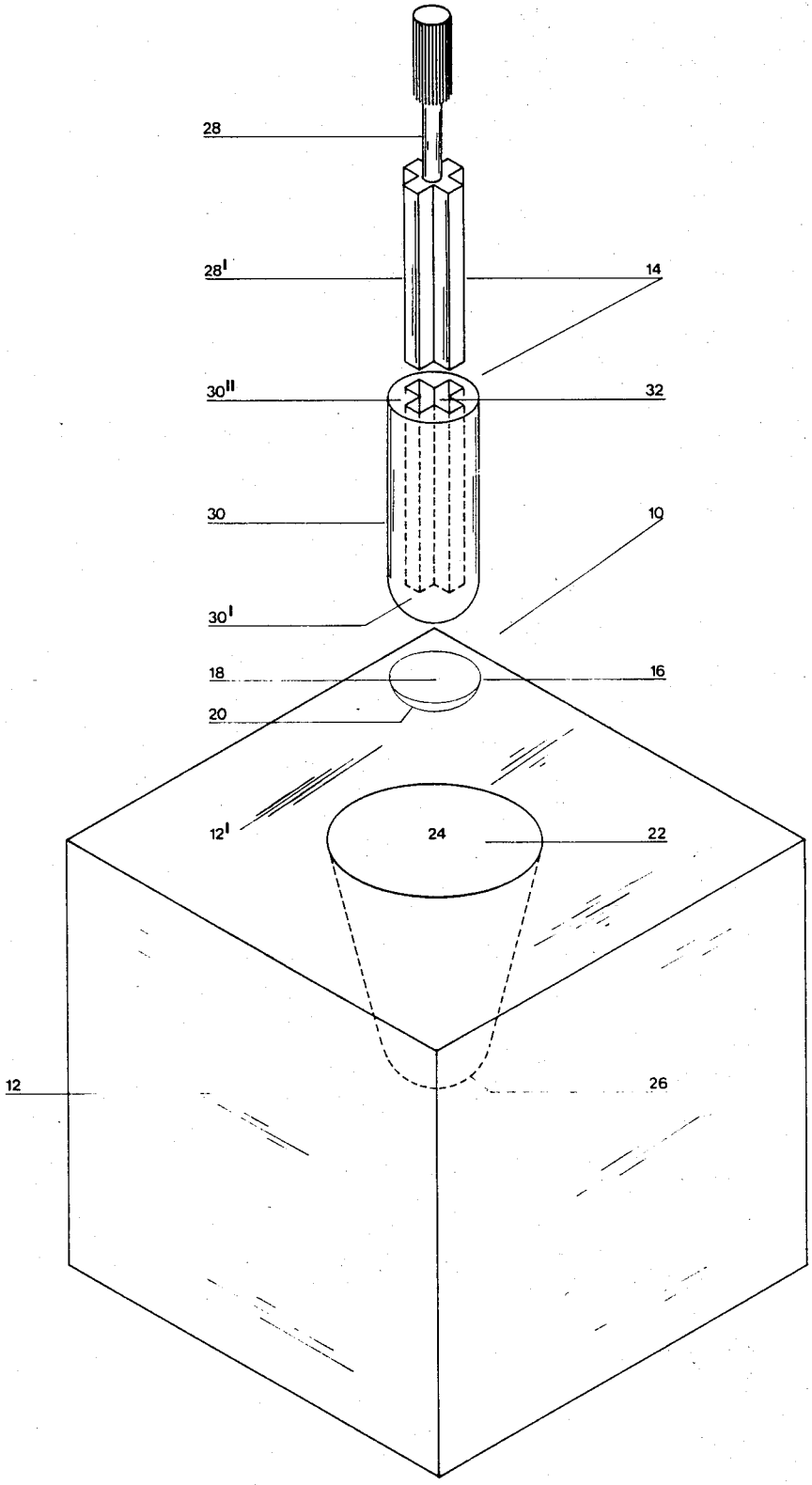
28
28'
14
30''
32
30
10
30'
18
16
20
12'
24
22
12
26

APPARATUS FOR APPLYING AND WORKING A CLEANSING PREPARATION ON CONTACT LENSES

BACKGROUND OF THE INVENTION

The present invention relates generally to the cleaning of contact lenses and more particularly to apparatus designed therefor.

Contact lenses for wearing in direct contact with the cornea of one's eyes as an alternative to eyeglasses for the correction of visual disorders are well-known. For a number of years, such lenses have conventionally been constructed of a relatively rigid, hydrophobic material, commonly called "hard" contact lenses. In recent years, contact lenses have also been constructed of hydrophilic plastic materials which are substantially flexible and pliant when saturated with water, commonly called "soft" contact lenses. Both types of contact lenses are in widespread conventional use. However, with the advent of the so-called soft contact lenses, such lenses have become increasingly popular due to the greater comfort in the wearing thereof. Both types of lenses require periodic cleaning, usually daily, with a special detergent preparation. Conventionally, the cleaning of contact lenses is usually carried out manually by holding each lens in the palm of one's hand, applying the cleaning preparation thereto and manually working the preparation onto the lens with the forefinger of the other hand. As will be recognized and appreciated by those knowledgeable in the art, this manual operation can provide substantial difficulty when carried out with soft contact lenses and is generally considered an aggravating necessity attendant to the use of contact lenses. Accordingly, one existing problem with this cleaning method is that often it is performed haphazardly with poor cleaning results. Furthermore, the manual handling of the lenses creates a danger of damaging them.

It is an object of the present invention to provide an apparatus particularly adapted for facilitating the cleansing of contact lenses of all types with only limited manual handling and manipulation thereof being required.

SUMMARY OF THE INVENTION

Briefly described, the present apparatus is adapted for applying and working a cleansing preparation on contact lenses of either the conventional soft or hard types. The apparatus basically includes a body having formed therein a recessed area having a surface formed of a material relatively soft and sufficiently abrasive to ordinary contact lenses only for effective surface cleaning thereof without damage thereto and having a concave area configured in substantial conformity to the outward convex surface of conventional contact lenses for receiving one such lens in substantial surface contact with the outward convex surface thereof. A handle arrangement is provided which includes a cleaning head having a surface also formed of the same or a similar soft and slightly abrasive material and having a convex projecting portion adapted for insertion in the recess of the body and configured in substantial conformity to the inward concave surface of conventional contact lenses for engagement with a lens in substantial surface contact with the inward concave surface thereof. In this manner, a contact lens may be cleansed using the present apparatus by application of an appropriate cleansing preparation to the concave area surface of the recess and to the convex projecting portion of the handle arrangement. Thereafter, the contact lens is placed in the concave area with the outward convex surface of the lens in contact with the concave area. The cleaning head of the handle arrangement is inserted in the recessed area with its convex projecting portion in engagement with the inward concave surface of the contact lens. The handle arrangement is then manipulated to apply a working action of the cleansing preparation to the inward and outward surfaces of the contact lens, thereby fully cleaning it without damage thereto.

In the preferred embodiment, the soft, slightly abrasive material employed is a foamed polymeric material having a relatively high number of expanded cells of the material per unit dimension and the body is formed entirely of such material. Preferably, the cleaning head is formed of the same material. The recessed area in the body includes a conical wall portion formed therein and a concave surface portion extending across the inward terminal end of the conical wall portion forming the concave area. The handle arrangement preferably includes a handle portion, with the cleaning head being a separable element, the handle portion and the cleaning head being compatibly formed for selective assembly and separation thereof.

BRIEF DESCRIPTION OF THE DRAWINGS

The FIGURE is an exploded perspective view of the preferred embodiment of the contact lens cleaning apparatus of the present invention.

DESCRIPTION OF THE PREFERRED EMBODIMENT

Referring now to the accompanying drawing, the preferred embodiment of the contact lens cleaning apparatus of the present invention is indicated in FIG. 1 generally at 10. Basically, the cleaning apparatus 10 includes a body member 12 and a handle assembly 14. A conventional contact lens is schematically indicated at 16 and basically is a circular transparent plastic disc having a concave inward surface 18 adapted for surface contact with the cornea of one's eye and a convex outward surface 20, the surfaces 18,20 being selectively configured to refract light to a particular chosen focal point.

The body member 12 is formed of a mass of a conventional foamed rubber, foamed plastic or other foamed polymer or a like material having sufficient softness and resiliency and being only slightly abrasive to conventional contact lenses sufficient substantially only for surface cleaning of conventional contact lenses so as not to damage them when lightly rubbed thereagainst. For example, one preferred material which may be employed in the construction of the body member 12 is a foamed polyester material produced by the Curon Division of Reeves Brothers, Inc., of Cornelius, N.C., under the product designation "Y508D" and having a density of 1.6 pounds per cubic foot, 44 expanded cells per lineal inch, and a compression deflection modulus at 25% deflection of 0.45 pounds per square inch. The body member 12 is formed to a substantially cubical or similar prismatic geometric shape and has a recessed area 22 formed in one side surface 12' of the body member 12. The recessed area 22 is defined by an inwardly tapering frusto-conical wall surface 24 and a concave wall surface 26 extending across the inward terminal end of the concave wall surface 24 and merging smoothly therewith. The concave wall surface 26 is configured in substantial conformity to the typical outward convex surface of a conventional contact lens, such as the convex surface 20 of the lens 16.

The handle assembly 14 includes a separable handle element 28 and cleaning head 30. The handle element 28 is a longitudinal molded plastic piece, preferably of a relatively rigid conventional thermoplastic polymeric material, of a sufficient length to be conveniently held in one's hand. One end 28' of the handle element 28 is molded to an X-shaped cross-sectional configuration. The cleaning head member 30 is formed of a mass of the same or a similar type of soft, resilient, slightly abrasive material as the body member 12, and is of a substantially cylindrical shape rounded at one end 30' to a convex shape configured in substantial conformity to the normal inward concave surface of a conventional contact lens, such as the concave surface 18 of the lens 16. A lengthwise opening 32 is formed in the other end 30'' of the cleaning head member 30 of an X-shaped configuration adapted for compatibly receiving the X-shaped end 28' of the handle element 28 by a relatively snug fit.

The operation of the present invention will thus be understood. When it is necessary or desirable to cleanse a contact lens, such as the routine daily cleansing ordinarily necessary, an appropriate amount of a suitable commercial cleansing preparation, usually only a few drops, is applied to the concave wall surface 26 in the recessed area 22 of the body member 12 and also to the convex end 30' of the cleaning head 30 of the handle assembly 14. The contact lens 16 is placed in the recessed area 22 with the convex outer surface 20 disposed downwardly and in substantially complete surface contact with the concave wall portion 26 of the recessed area 22. The handle assembly 14 is then manually manipulated by its handle element 28 to insert its cleaning head 30 into the recessed area 22 to bring its convex end 30' into substantially complete surface engagement with the upwardly facing concave surface 18 of the lens 16. The handle assembly 14 is then manually manipulated, preferably by a reciprocating rotational movement to cause each surface 18,20 of the lens 16 to be lightly rubbed respectively by the rounded convex end 30' of the cleaning head 30 and by the concave wall surface 26 of the recessed area 22, thereby applying the cleansing preparation to such lens surface 18,20 for cleaning them. Ordinarily, commercial cleansing preparations recommend manual cleaning manipulation of lens according to the above-described process to be carried out for approximately 20 seconds. However, with the present apparatus it will be possible to reduce the amount of cleaning time usually required. After the manipulative working of the cleansing preparation on the lens surfaces 18,20 the handle assembly 14 is withdrawn from the recess area 22 and the lens 16 is removed therefrom and rinsed in a commerical saline or other recommended rinsing solution and then either stored in a conventional storage case or placed in one's eye to be worn.

Several advantages are provided by the present invention. First, the cleaning operation of contact lenses is made considerably easier and neater in that it is no longer necessary to work the lens in one's hand using a detergent solution. Furthermore the softness and non-abrasiveness of the material from which the working members of the present apparatus are constructed reduces the likelihood of damaging the lens during the cleaning process, which is a constant problem in the manual process of cleaning contact lenses. Additionally, the present apparatus provides a substantially more thorough and effective cleaning of the lens than is usually achieved by the manual cleaning process. With the present invention, the only manual handling required in the cleaning of a contact lens is the placement of the lens in and the removal thereof from the recessed area 22 and the holding of the lens in the rinsing thereof following the cleaning process, thereby considerably reducing the necessity of manual handling of the lens.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. Apparatus for applying and working a cleansing preparation on contact lenses of the soft hydrophilic type, the hard hydrophobic type or the like with limited manual handling and manipulation thereof comprising a body having formed therein a recessed area having a surface formed of a material relatively soft and sufficiently abrasive to said contact lenses only for effective surface cleaning thereof without damage thereto and having a concave area configured in substantial conformity to the outward convex surface of said contact lenses for receiving one said contact lens in substantial surface contact with said outward convex surface and handle means including a cleaning head having a surface formed of a material relatively soft and sufficiently abrasive to said contact lenses only for effective surface cleaning thereof without damage thereto and having a convex projecting portion adapted for insertion in said recess of said body and configured in substantial conformity to the inward concave surface of said contact lens for engagement with said one contact lens in substantial surface contact with said inward concave surface thereof, whereby said one contact lens may be cleansed by application of said cleansing preparation to said surface of said concave area and said surface of said convex projecting portion, disposition of said one contact lens in said recessed area with said outward convex surface of said one contact lens on said concave area, insertion of said cleaning head in recessed area with said convex projecting portion in engagement with said inward concave surface of said contact lens, and manipulation of said handle means to apply a working action of said cleansing preparation to said inward and outward surfaces of said one contact lens.

2. The contact lens cleansing apparatus of claim 1 and characterized further in that said body is formed entirely of said soft, sufficiently abrasive material.

3. The contact lens cleansing apparatus of claim 1 and characterized further in that said concave area surface and said cleaning head surface are formed of the same said soft, sufficiently abrasive material.

4. The contact lens cleansing apparatus of claim 3 and characterized further in that said material is a foamed polymeric material having a relatively high number of expanded cells of the material per unit dimension.

5. The contact lens cleansing apparatus of claim 4 and characterized further in that said body is formed entirely of said soft, sufficiently abrasive material.

6. The contact lens cleansing apparatus of claim 5 and characterized further in that said recessed area includes a conical wall portion and a concave surface portion extending across the inward terminal end of said conical wall portion forming said concave area.

7. The contact lens cleansing apparatus of claim 6 and characterized further in that said handle means includes a handle portion and means on said handle portion and said cleaning head for selective assembly and separation thereof.

8. The contact lens cleansing apparatus of claim 1 and characterized further in that said recessed area includes a conical wall portion and a concave surface portion extending across the inward terminal end of said conical wall portion forming said concave area.

9. The contact lens cleansing apparatus of claim 1 and characterized further in that said handle means includes a handle portion and means on said handle portion and said cleaning head for selective assembly and separation thereof.

* * * * *